US007963830B2

(12) United States Patent
Luddy et al.

(10) Patent No.: US 7,963,830 B2
(45) Date of Patent: Jun. 21, 2011

(54) SYSTEM FOR DIRECTING AND CONTROLLING TWO SEPARATE STREAMS OF AIR TO A KITCHEN

(75) Inventors: Robert L. Luddy, Youngsville, NC (US); William B. Griffin, Lancaster, PA (US); Nicolas I. Perry, Plymouth Meeting, PA (US)

(73) Assignee: Captive-Aire Systems, Inc., Raleigh, NC (US)

( * ) Notice: Subject to any disclaimer, the term of this patent is extended or adjusted under 35 U.S.C. 154(b) by 1458 days.

(21) Appl. No.: 10/947,620

(22) Filed: Sep. 22, 2004

(65) Prior Publication Data

US 2006/0060187 A1 Mar. 23, 2006

(51) Int. Cl.
*F24C 15/20* (2006.01)
*F21C 15/08* (2006.01)

(52) U.S. Cl. ..... 454/49; 126/299

(58) Field of Classification Search ..... 454/49
See application file for complete search history.

(56) References Cited

U.S. PATENT DOCUMENTS 3,260,189 A 7/1966 Jensen
3,457,850 A 7/1969 Sweet et al.
3,513,766 A 5/1970 Ahlrich
3,530,784 A 9/1970 Courchesne
3,687,053 A * 8/1972 Henson et al. ..... 454/188
3,800,689 A 4/1974 Brown
3,890,887 A 6/1975 Kaufman et al.
4,043,319 A 8/1977 Jensen
4,134,394 A 1/1979 Otenbaker
4,373,509 A * 2/1983 Neitzel et al. ..... 126/299 D
4,484,563 A * 11/1984 Fritz et al. ..... 126/299 D
4,705,457 A * 11/1987 Belusa ..... 417/22
6,058,929 A 5/2000 Fritz

* cited by examiner

*Primary Examiner* — Steve McAllister
*Assistant Examiner* — Ksanovic Helena
(74) *Attorney, Agent, or Firm* — Coats & Bennett, P.L.L.C.

(57) ABSTRACT

A system for directing two separate streams of air to a commercial or industrial kitchen environment. The system includes a dual airflow plenum that is normally disposed adjacent a kitchen exhaust hood. Typically one stream of air is a tempered, that is heated or cooled, and is directed through the dual airflow plenum to where it is exhausted at an area or point adjacent the exhaust hood. A second untempered, that is ambient air, air stream is directed through the same dual air flow plenum and is exhausted into an area adjacent the exhaust hood. Preferably the plenum is positioned with respect to the exhaust hood such that the outlet for the untempered air is disposed generally between the exhaust hood and the outlet for the tempered air. Moreover, the relative velocity of the two air streams is maintained or controlled such that the velocity of the tempered air stream is equal to or greater than the velocity of the untempered air stream.

17 Claims, 4 Drawing Sheets

SYSTEM FOR DIRECTING AND CONTROLLING TWO SEPARATE STREAMS OF AIR TO A KITCHEN

FIELD OF INVENTION

The present invention relates to commercial kitchen systems and more particularly to a system for controlling the flow of makeup and conditioned air into a kitchen environment.

BACKGROUND OF THE INVENTION

Typically a commercial kitchen includes a stove or a cooking unit. Over the stove or cooking unit there is provided an exhaust hood. During the cooking operation, air is pulled over the stove and up through the exhaust hood where the air, laden with smoke, cooking aromas, etc. is exhausted from the kitchen and eventually the building. Because the exhaust system continuously draws air from the kitchen area, it is necessary to replenish air to the kitchen area. This is typically provided by what is often termed a makeup air unit. Makeup air units pull ambient air from the outside the building and disperse the air into the kitchen area. In moderate climates it is appropriate to disperse the makeup air in the vicinity of the exhaust hood. Consequently the dispersed makeup air is simply pulled over the stove area and out the exhaust system.

In cold and hot climates a problem can be presented. By simply directing ambient air into the kitchen area, it can be difficult to control the temperature within the kitchen at a comfortable level. Thus, it is known to condition the ambient air prior to the air being dispersed into the kitchen area. For example, in extremely cold environments it is beneficial in some cases to heat the makeup air before the air is dispersed into the kitchen. In extremely hot climates it may be beneficial to cool the air prior to the air being dispersed into the kitchen. However, conditioning the makeup air before dispersement into the kitchen can be an expensive undertaking. This is because some of the conditioned air will immediately be induced into the area over the stove and up and through the exhaust system. Thus, the energy required to condition that portion of the makeup air is not effectively utilized.

Therefore, to conserve energy and to provide a more cost effective make up system for commercial kitchens, it is desirable to provide a makeup air system that will provide two systems or streams of air, an untempered system of air and a tempered system of air. The idea is to provide a system where the untempered or ambient air is truly makeup air inasmuch as a substantial portion of that air stream is utilized to be recirculated over the stove and out the exhaust systems, while the tempered system or stream of air can be utilized to heat or cool the kitchen area. The problem is to devise a system where these two systems of air can be efficiently provided and controlled such that a majority or a substantial portion of the untempered air is utilized for exhaust purposes while a majority or a substantial portion of the tempered air is used for heating or cooling and generally making the kitchen area comfortable.

SUMMARY OF THE INVENTION

The present invention entails a method of directing two streams of air into a kitchen having an exhaust hood through which air is exhausted from the kitchen. The two streams of air include a conditioned stream and an unconditioned stream. The method entails directing the conditioned air stream into the kitchen and out an outlet in the vicinity of the exhaust hood. Further the method entails directing the unconditioned air stream into the kitchen and out an outlet positioned generally between the exhaust hood and the outlet for the conditioned air stream. The velocity of one or both air streams is controlled such that the velocity of the conditioned air stream equals or exceeds the velocity of the unconditioned air stream.

In one particular embodiment of the present invention, a dual airflow plenum is provided and is mounted or stationed adjacent the exhaust hood. The dual airflow plenum includes two separate air chambers, one air chamber to accommodate the conditioned air stream and the other air chamber to accommodate the unconditioned air stream. The dual airflow plenum is positioned adjacent the exhaust hood such that an outlet for the unconditioned stream or system of air is positioned between the exhaust hood and an outlet for the conditioned stream of air. This arrangement and this position of the air plenum with respect to the exhaust hood tends to encourage substantial portions of the unconditioned air into and through the exhaust hood while substantial portions of the conditioned air is dispersed into the adjacent kitchen area for cooling or heating the air therein.

In another embodiment of the present invention, a dual air flow kitchen plenum is provided and functions to direct two separate streams or systems of air into a kitchen. The plenum includes a rectangular or square frame having a series of sides, an open top and an open bottom. A top panel is secured over the frame. First and second air inlets are formed in the top for permitting first and second air streams to be directed into the kitchen plenum. A divider extends across the frame and divides the frame into two areas. There is also provided first and second pairs of spaced perforated plates that are secured in the frame. The divider and frame form two chambers. One stream of air is directed into the first inlet and is constrained to move through one chamber and through the first pair of perforated plates. A second stream of air is directed into the second inlet and is constrained to move through the second chamber and through the second pair of perforated plates.

In another embodiment of the present invention, a combination kitchen hood and dual airflow plenum is provided. Here the kitchen exhaust hood and the dual airflow plenum are disposed adjacent each other. The dual airflow plenum includes a frame structure that forms two air chambers. One chamber is particularly adapted to receive untempered air while the other chamber is particularly adapted to receive tempered air. To control the distribution of tempered and untempered air within the kitchen having the combination exhaust hood and dual airflow plenum, the outlet for the untempered air, associated with the plenum, is disposed adjacent the exhaust hood, while the outlet for the tempered air, associated with the plenum, is disposed outwardly of the outlet for the untempered air. By controlling the relative velocity of the two streams of air, the untempered air is encouraged to enter the exhaust hood while the tempered air is engaged to enter the kitchen area for generally heating or cooling the air therein.

Other objects and advantages of the present invention will become apparent and obvious from a study of the following description and the accompanying drawings, which are merely illustrative of such invention.

DESCRIPTION OF AN EXEMPLARY EMBODIMENT OF THE PRESENT INVENTION

Figure 4:
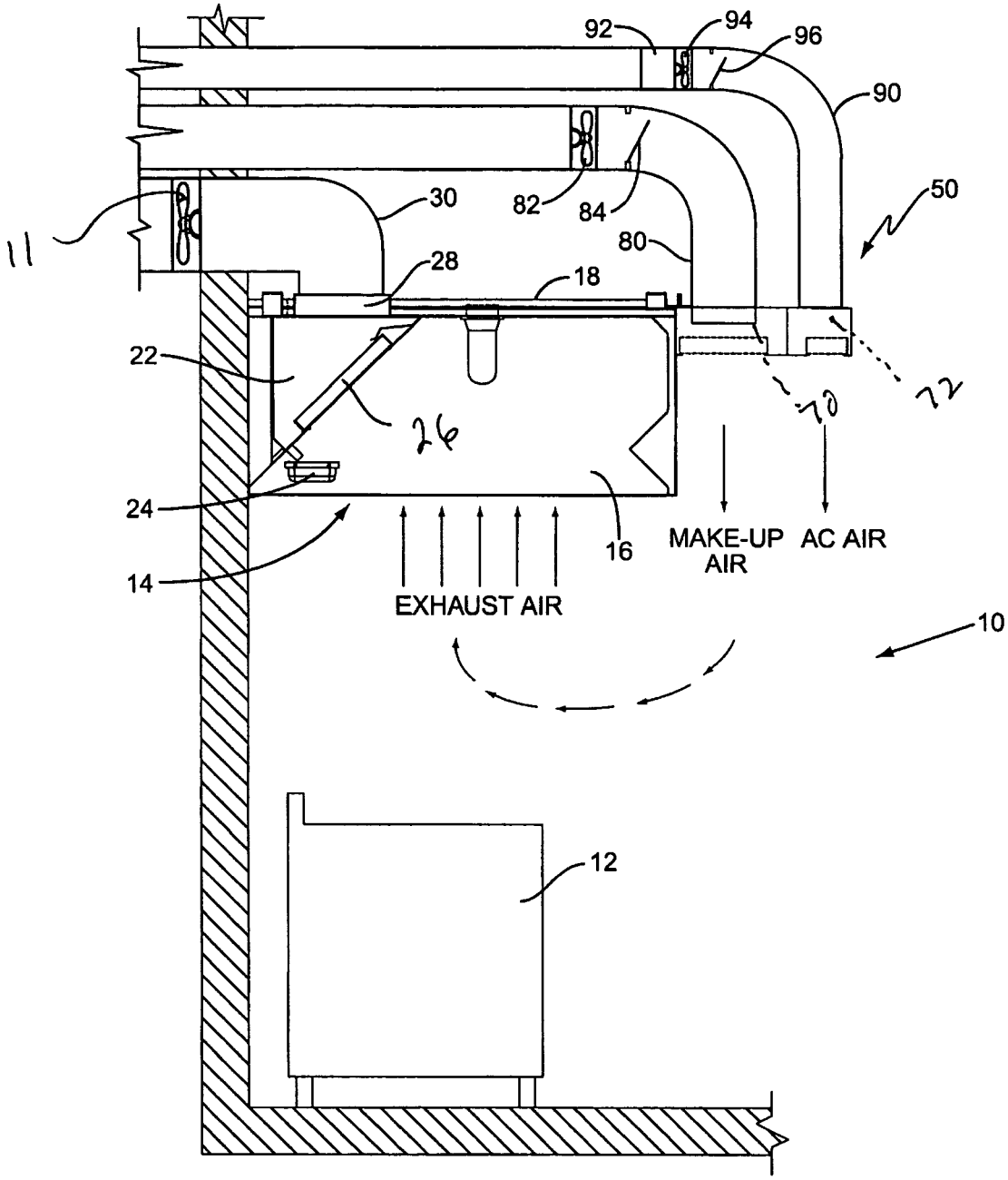
FIG. 4 is a schematic side elevational view showing the system of the present invention incorporated into a commercial kitchen.

With further reference to the drawings and particularly FIG. 4, there is shown therein a commercial kitchen, which is indicated generally by the numeral 10. Disposed in the kitchen 10 is a stove or cooking unit 12. Mounted to the adjacent wall of the kitchen, above the stove 12, is an exhaust hood indicated generally by the numeral 14. In typical fashion, exhaust hood 14 includes a surrounding wall 16 and a top 18. Formed in the top 18 is an opening for receiving an exhaust riser or collar 28. This forms an outlet about the top of the exhaust hood 14. Disposed about the backside of the exhaust hood 14 is a grease confinement area 22. Grease confinement area 22 is designed to receive a filter 26 and further includes a grease cup 24 for catching and retaining grease extracted from the exhaust stream.

Connected to the exhaust collar 28 is a duct 30. Duct 30 leads from the exhaust collar 28 out the wall or ceiling of the kitchen to an exterior area. In conventional fashion the exhaust hood 14 would be operatively associated with an exhaust fan 11 that in turn is operative to pull air from the kitchen area 10 up past the stove 12 and through the exhaust hood 14 and out the duct 30.

Mounted adjacent exhaust hood 14 is a double air plenum indicated generally by the numeral 50. As will be appreciated from subsequent portions of this disclosure, the double air plenum 50 functions to control and direct two separate systems or streams of air into the kitchen area 10. More particularly, the double air plenum 50 is designed to facilitate the control of two separate streams of air such that one stream of air is encouraged to be induced into and through the exhaust hood 14 while the other system of air is encouraged to be dispersed generally into the kitchen area 10. In that regard, in some environments it is advantageous to heat or cool one of the systems of air. The system or stream of air that is heated or cooled is referred to as conditioned air or tempered air. On the other hand, the other system or stream of air is referred to as untempered air. As will be appreciated from subsequent portions of the disclosure, the system of the present invention disperses both the untempered and tempered systems of air adjacent the exhaust hood 14. The untempered stream or system of air is dispersed adjacent the exhaust hood while the tempered or conditioned system of air is dispersed outwardly of the area where the untempered system of air is dispersed. As seen in FIG. 4, the outlet for the untempered system of air is disposed generally between the exhaust hood 14 and the outlet for the tempered system of air.

Now turning to the structure of the double air plenum 50, and to FIGS. 1-3B, this structure comprises a rectangular or square frame 52. Frame 52 in the case of this embodiment includes four sides 52A, 52B, 52C and 52D. Although frame 52 can be constructed of various materials, in the present embodiment the frame 52 is constructed of sheet metal or stainless steel and the individual sides 52A-52D are secured together by weldment or other suitable means and the seams are generally sealed by caulking or other suitable means such that air or air flow passing through the plenum 50 can be generally confined about the walls 52A-52D.

Secured to the top of frame 52 is a top panel 54. Top panel 54 includes first and second openings. Secured to the first opening is a first outlet or collar 56. Secured or formed around the second opening is a second outlet or collar 58. As will be appreciate from subsequent portions of the disclosure, the first inlet 56 is designed to receive a stream of untempered makeup air. Second inlet 58, on the other hand, is designed to receive a separate stream or system of air that will be tempered or conditioned.

Figure 3A:
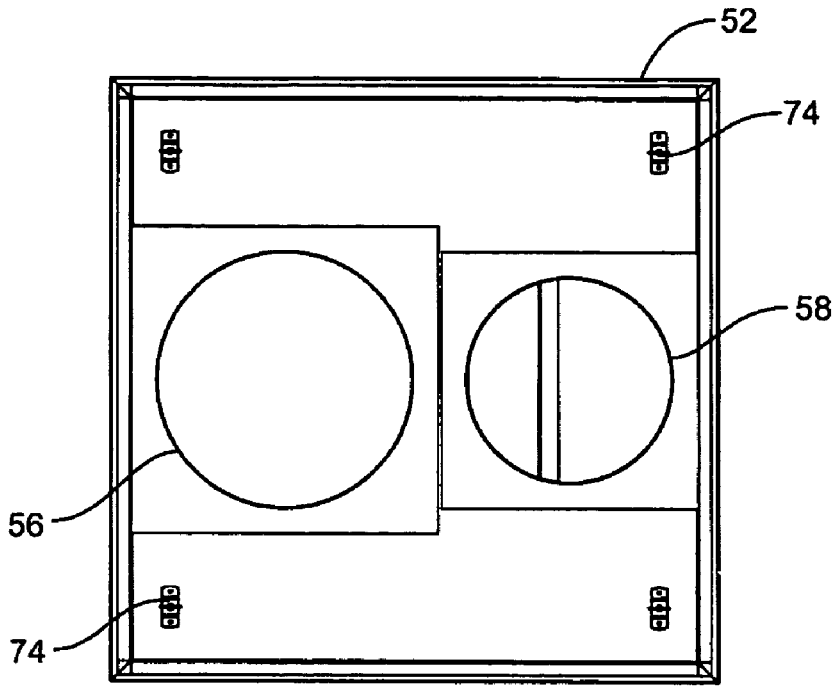
FIG. 3A is a top plan view of the dual airflow plenum.
Figure 3B:
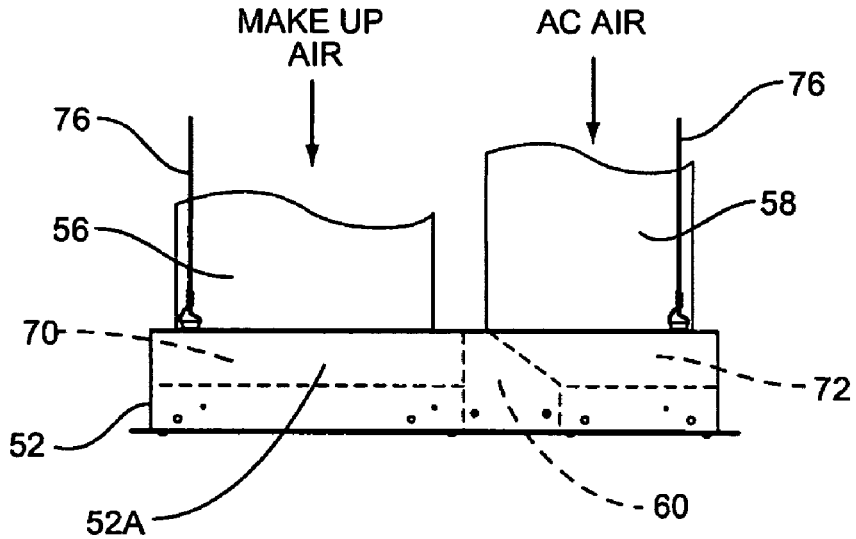
FIG. 3B is a side elevational view of the dual airflow plenum.

Double air plenum 50 is constructed so as to form two separate air chambers, chamber 70 and chamber 72. See FIG. 3B. In order to form chambers 70 and 72 a divider 60 is connected between opposing sides 52A and 52C. As shown in FIG. 3B, divider 60 is of a height that is generally equal to the height of the sides of the frame 52. Divider 60 includes an upper top surface 60A that abuts against the bottom surface of top 54. A sealed relationship is formed between the top surface 60A of the divider 60 and the top 54 of the plenum 50. In addition, divider 60 includes an angled upper surface 60B that extends generally downwardly from the top surface 60A. As seen in FIG. 3B, divider 60 basically divides the frame 52 into two chambers, chamber 70 and chamber 72.

Figure 1:
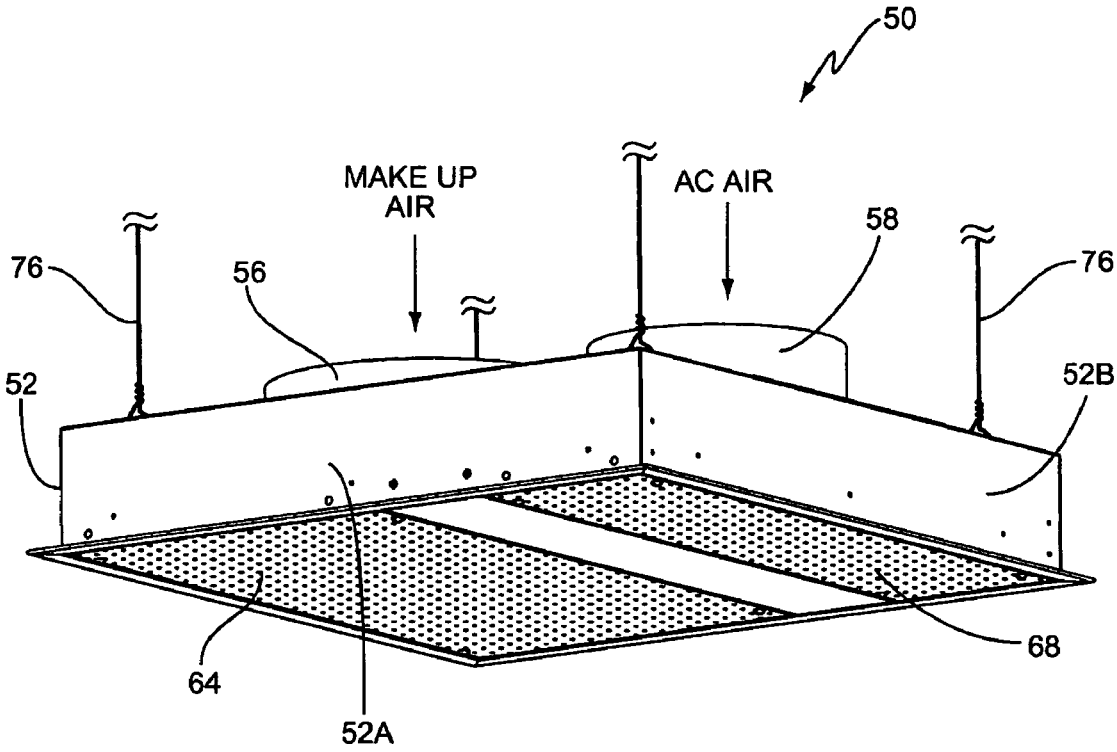
FIG. 1 is a perspective view of a dual airflow plenum that can be utilized to direct two separate systems of air into a kitchen area.
Figure 2:
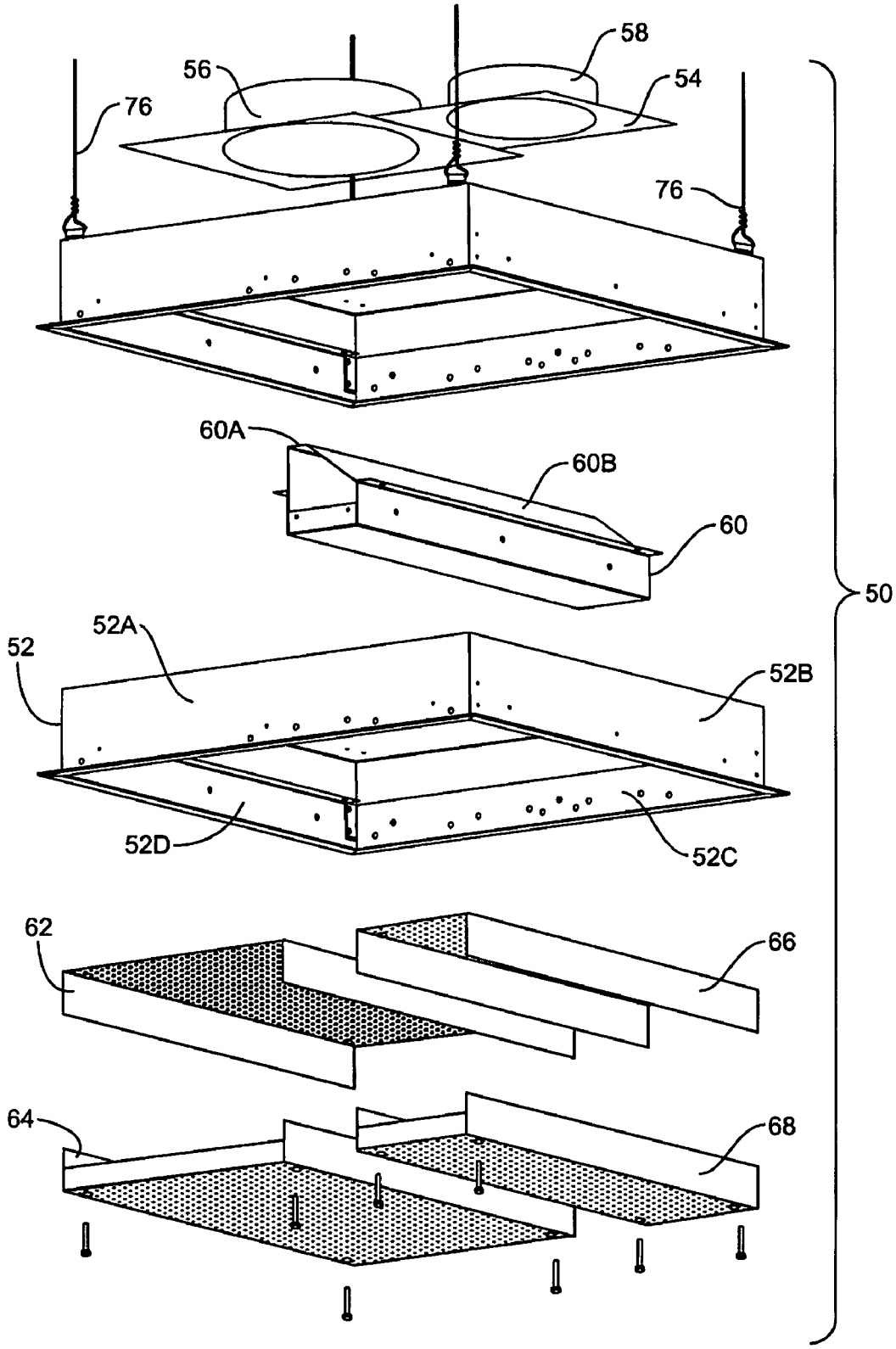
FIG. 2 is an exploded view of the dual airflow plenum of FIG. 1.

Each of the chambers includes a pair of perforated plates disposed about the lower portion of the plenum 50. A first pair of perforated plates is disposed in chamber 70. This first pair of perforated plates includes plates 62 and 64. As seen in FIG. 2, the plates are of a general U-shape construction and are turned such that the plates are opposed to each other. Likewise, in the other chamber 72, a second pair of perforated plates is secured within the frame 52 of the plenum 50. These plates are referred to as plates 66 and 68. Like the first pair of plates in chamber 70, these plates are of a U-shape construction and are turned so as to oppose each other, again, as shown in FIG. 2. The first and second pairs of perforated plates can be secured into the plenum 50 in various ways. For example, the upper plates 62 and 66 can be anchored and secured by rivets, weldment or other suitable means to the frame 52. Bottom plates 64 and 68 can be secured to the upper plate 62 and 66 by bolts or screws.

The double air plenum 50 can be suspended from the ceiling or other structure in the kitchen area 10. To accommodate for suspension, the top panel 54 of the plenum 50 is provided with a series of hanger brackets 74. See FIG. 3A. Each hanger bracket 74 can be connected to a flexible cable or wire 76. The respective flexible cables 76 can be extended upwardly and secured to an overlying support structure in the kitchen area.

As briefly alluded to before, the double air plenum 50 is preferably strategically located with respect to the exhaust hood 14. Note in FIG. 4 where the plenum 50 is oriented with respect to the exhaust hood such that chamber 70 lies adjacent the exhaust hood and the outlet thereof disposed adjacent the exhaust hood and between the exhaust hood and the outlet of the other chamber 72. As will be discussed later, chamber 70 is utilized to handle and disperse untempered makeup air while the other chamber, 72, handles and disperses tempered or conditioned air.

Connected to the dual air plenum 50 is a pair of ducts, duct 80 and duct 90. Duct 80 is connected to inlet 56 and extends therefrom to an exterior air area of the building housing the kitchen 10. Duct 90 is connected to inlet 58 and extends therefrom to an exterior area of the building housing kitchen 10. In the embodiment illustrated herein, duct 80 is designed to channel ambient or untempered air to the plenum 50. Thus, it is appreciated that associated with the duct 80 would be a variable speed fan indicated by numeral 82 and a damper 84. The velocity of air passing through duct 80 can be controlled by the variable speed fan 82 and/or the damper 84.

Associate with duct 90, is an air conditioning unit 92 that is operative to heat and/or cool the air being directed through duct 90 to the plenum 50. As schematically illustrated in FIG. 4, air conditioning unit 92 has associated therewith a variable speed fan indicated by numeral 94. Additionally duct 90 includes a damper 96. It is also appreciated that in the case of both dampers 84 and 96 that these dampers could be incorporated into the structure of the plenum 50.

In any event, the velocity of the air dispersed from chambers 70 and 72 of the plenum 50 can be controlled. In particular, the velocity of the separate air streams can be controlled by appropriately adjusting either of the variable speed fans 82 and 94 and/or adjusting the dampers 84 and 96.

It has been found that by controlling the velocity of the tempered or conditioned air being dispersed from chamber 72 or out the perforated plate 66 and 68 can influence and control the flow or pattern of air distribution from the plenum 50. That is, by maintaining or controlling the velocity of the tempered or conditioned air such that the velocity is equal to or greater than the velocity of the untempered air, it has been found that the untempered air is induced to pass over the stove 12 and upwardly through the exhaust hood 14 while the tempered or conditioned air dispersed from the plenum tends to be directed into the kitchen area for heating or cooling the air therein. It is postulated that by maintaining the velocity of the tempered or conditioned air to equal or exceed the velocity of the untempered air, this tends to isolate the untempered air from moving outwardly into the kitchen area 10 and because of the relatively low pressure existing in the exhaust hood area, the untempered air system or stream is induced inwardly over the stove 12 and up and out the exhaust hood 14. It is appreciated that direct control can be exercised over either system of air. The important consideration is that either system or both systems of air are controlled such that the velocity of the tempered or conditioned system of air equals or exceeds the velocity of the untempered or ambient system of air.

It is contemplated that in a preferred design that the velocity of the untempered air would be delivered at approximately 150 fpm while the velocity of the conditioned or tempered air would be delivered at 200 fpm. In a case where the tempered air is cool, for example, the air-conditioned air under pressure tends to encourage the untempered air to move towards the exhaust hood 14, thus preventing hot air from entering the kitchen area 10. The hot air being exhausted from chamber 70 is forced into the exhaust hood to be exhausted from the kitchen while the cooled or conditioned air is free to mix with the air in the kitchen area 10.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A combination kitchen exhaust hood and dual air flow plenum for directing two separate air streams into an area adjacent to and outside of an exhaust hood within a kitchen, comprising:

a. a housing including a surrounding sidewall structure and a top;

b. a first air inlet formed in the top;

c. a second air inlet formed in the top;

d. a divider extending across the surrounding sidewall structure;

e. wherein the divider and surrounding sidewall structure form two separate air chambers with each air chamber being communicatively open to one of the first or second inlets;

f. each of the air chambers including two horizontally disposed perforated plates with one perforated plate being disposed over the other perforated plate such that each air chamber includes two vertically spaced perforated plates;

g. an exhaust hood for exhausting air from an underlying stove, and wherein the exhaust hood and dual airflow plenum are disposed adjacent each other; and h. each of the air chambers having a generally horizontal outlet configured to discharge one of the air streams downwardly with respect to the exhaust hood and into an area exteriorly of the exhaust hood.

2. The combination kitchen exhaust hood and dual air flow plenum of claim 1 wherein one of the air chambers is an untempered air chamber and the other air chamber is a tempered air chamber and wherein the dual air flow plenum is disposed adjacent the exhaust hood such that the untempered chamber lies between the exhaust hood and the tempered chamber.

3. The combination kitchen exhaust hood and dual air flow plenum of claim 1 including a first conduit connected to the first inlet and a second conduit connected to the second inlet and wherein the first and second conduits are adapted to channel first and second separate air streams to the dual air flow plenum; and at least one variable speed fan for controlling the velocity of the air passing through one conduit.

4. The combination kitchen exhaust hood and dual air flow plenum of claim 3 wherein the first conduit is adapted to channel an untempered air stream to the dual air flow plenum and wherein the second conduit is adapted to channel a tempered air stream to the dual air flow plenum, and wherein the variable speed fan maintains a relative air velocity between the tempered air stream and the untempered air stream such that the velocity of the tempered air stream is equal to or greater than the velocity of the untempered air stream.

5. The combination kitchen exhaust hood and dual air flow plenum of claim 1 including a pair of conduits communicatively connected to the first and second inlets for directing two separate air streams to the dual air flow plenum; and means for controlling the relative velocity of the two air streams such that the velocity of one air stream is equal to or greater than the velocity of the other air stream.

6. The combination kitchen exhaust hood and dual air flow plenum of claim 5 wherein one of the conduits channel untempered air while the other conduit channels tempered air and wherein the means for controlling the velocity of the air includes means for maintaining the velocity of the tempered air stream such that the velocity of the tempered air stream equals or exceeds the velocity of the untempered air stream.

7. The combination kitchen exhaust hood and dual air flow plenum of claim 5 wherein the means for controlling the velocity of one air stream with respect to the other includes an adjustable damper.

8. A dual air flow kitchen plenum for directing two separate streams of air into a kitchen area adjacent an exhaust hood, comprising:

a. a rectangular or square frame having a series of sidewalls, an open top and an open bottom;

b. a top panel secured to the frame;

c. a first air inlet formed in the top for permitting a first air stream to be directed into the kitchen plenum;

d. a second air inlet formed in the top for permitting a second stream of air to be directed into the kitchen plenum;

e. a divider extending across the frame and dividing the frame into two areas;

f. a first pair of vertically spaced generally horizontally disposed perforated plates secured in one area between the divider and a portion of the frame such that one perforated plate lies over the other perforated plate;

g. a second pair of vertically spaced and generally horizontally disposed perforated plates secured in the other area between the divider and another portion of the frame such that one perforated plate lies over the other perforated plate;

h. wherein the divider and frame form two chambers and wherein one stream of air directed into the first inlet is constrained to move through one chamber and through the first pair of perforated plates where the first stream of air is dispersed, and wherein the second stream of air is directed into the second inlet and is constrained to move therefrom through the second chamber and through the second pair of perforated plates disposed therein; and i. each air chamber including a horizontal outlet for discharging the air stream passing through the air chamber downwardly from the kitchen plenum into the kitchen area adjacent to and exteriorly of the exhaust hood.

9. The dual air flow plenum of claim 8 including a first conduit connected to the first inlet and a second conduit connected to the second inlet and wherein the first conduit is operative to direct the first stream of air to the plenum while the second conduit is operative to direct the second stream of air to the plenum; and means for controlling the velocity of the first stream of air relative to the second stream of air.

10. The dual air flow plenum of claim 9 wherein the means for controlling the velocity of one stream of air with respect to the other includes means for maintaining the velocity of one stream of air equal to or greater than the velocity of the other stream of air.

11. The dual air flow plenum of claim 9 wherein the means for controlling the velocity of one stream of air relative to the other stream of air includes at least one variable speed fan.

12. The dual air flow plenum of claim 9 wherein the means for controlling the velocity of one stream of air relative to the other stream of air includes at least one adjustable damper.

13. The dual airflow plenum of claim 8 wherein the divider includes an upper surface that is angled with respect to the top panel.

14. The dual airflow plenum of claim 8 wherein a portion of the divider includes a height that is approximately the same height as the frame.

15. The dual air flow plenum of claim 9 further including an air conditioning unit for heating or cooling one stream of air passing through one conduit.

16. The dual air flow plenum of claim 15 including a fan for inducing the other stream of air through the other conduit such that two separate streams of air are directed to the plenum, one stream of air being a tempered stream of air and the other stream of air being an untempered stream of air.

17. The dual air flow plenum of claim 8 wherein the dual air flow plenum includes a height and a width, and wherein the height is substantially less than the width.

* * * * *